US005966922A

United States Patent [19]

Cossio

[11] Patent Number: 5,966,922

[45] Date of Patent: Oct. 19, 1999

[54] PROCESS OF MANUFACTURING DIAMOND CUT HOLLOW ROPE CHAIN JEWELRY

[75] Inventor: Eduardo Cossio, Ica, Peru

[73] Assignee: Donald D. Cross, Key Biscayne, Fla.

[21] Appl. No.: 09/024,647

[22] Filed: Feb. 17, 1998

[51] Int. Cl.[6] ..... B21L 15/00

[52] U.S. Cl. ..... 59/35.1; 59/80

[58] Field of Search ..... 59/3, 35.1, 80, 59/82

[56] References Cited

U.S. PATENT DOCUMENTS

| | | | |
|---|---|---|---|
| 5,125,225 | 6/1992 | Strobel | 59/35.1 |
| 5,353,584 | 10/1994 | Strobel et al. . | |
| 5,408,820 | 4/1995 | Strobel et al. . | |
| 5,437,149 | 8/1995 | Strobel . | |
| 5,471,830 | 12/1995 | Gonzales | 59/35.1 |
| 5,487,264 | 1/1996 | Strobel . | |
| 5,526,639 | 6/1996 | Gonzales | 59/35.1 |
| 5,535,583 | 7/1996 | Holzer et al. . | |
| 5,581,993 | 12/1996 | Strobel . | |
| 5,626,012 | 5/1997 | Fabbro | 59/35.1 |
| 5,737,910 | 4/1998 | Rozenwasser | 59/35.1 |
| 5,797,258 | 8/1998 | Strobel et al. | 59/35.1 |

*Primary Examiner*—David Jones

*Attorney, Agent, or Firm*—Malin, Haley, DiMaggio & Crosby, P.A.

[57] ABSTRACT

A process for manufacturing diamond cut rope chain jewelry from hollow rings of gold material or other precious metal or alloy. The process provides for the formation of hollow rope jewelry having faceted surfaces formed by a diamond cut process. The diamond cut process is facilitated by positioning the chain on the drum of a diamond cut lathe using a tool having a convex head of polished steel that is precisely positioned for urging the chain into position. The tensile strength of the chain is increased by a thermal tempering process to achieve the required tensile strength for resistance to breakage.

4 Claims, 2 Drawing Sheets

PROCESS OF MANUFACTURING DIAMOND CUT HOLLOW ROPE CHAIN JEWELRY

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention relates to jewelry manufacturing, and particularly to a process for manufacturing diamond cut hollow rope chain jewelry.

2. Description of Related Art

It is known in the background art to produce rope chain jewelry items comprised of rings of gold alloy material. Jewelry rope chains, such as necklaces or the like, are made from an interlocking configuration of individual ring shaped annular links which are intertwined to form a rope-like structure. In general, jewelry rope chains can be made of solid links, or hollow links. Chains made of solid links are known as "solid rope chains" and chains made of hollow links are known as "hollow rope chains".

One method of producing rope chain jewelry involves the use of a mechanical cutting process wherein a mass of solid gold or gold alloy is used to create solid jewelry chains having the appearance and/or texture of rope. According to the process of the background art, a solid gold chain is placed on a rotatable drum of a lathe having a diamond tipped cutting element. Next, cold water is sprayed over the drum and chain and frozen thereby forming a layer of ice that completely covers the chain and causes the chain to be fixedly secured to the drum. Finally, the diamond cutting tool is used to remove portions of the ice covering the chain and to selectively cut or remove portions of the gold chain material by applying the diamond cutting tool to the chain while the drum rotates.

The diamond cutting process of the background art, however, has not been successfully applied to chains produced with hollow rings. The background art does reveal, however, attempts to give the "appearance" of diamond-cut to hollow rope chains by polishing or deforming surfaces of the chain utilizing a blunt point tool. Specifically, a blunt point tool is used in lieu of a diamond cutting tool to flatten, not cut, the rings to give the appearance of diamond cut faces.

U.S. Pat. No. 5,581,993, issued to Strobel et al., discloses a hollow diamond cut rope chain with multi-faceted surfaces formed by incremental deforming hollow links resulting in a simulated diamond cut multifaceted jewelry rope chain. The '993 Patent, however, suffers from the above-referenced limitations of the background art by failing to achieve a hollow rope chain having actual diamond cut surfaces.

In addition, a number of other references disclose similar limitations. U.S. Pat. No. 5,535,583, issued to Holzer et al. discloses a method of faceting a hollow rope chain wherein the chain is moved continuously over pulley guides whereon the exposed chain surface is deformed without the removal of material. U.S. Pat. Nos. 5,353,584, 5,408,820, 5,437,149, and 5,487,264, issued to Strobel et al., each disclose hollow rope chain jewelry having simulated diamond cut faceted surfaces formed by deforming (i.e. flattening) the hollow links.

The diamond cutting methods of the background art, however, are limited to use with solid alloy's and have not be capable of use in connection with "hollow" rings of gold alloy material as the use of hollow rings results in a chain having a tensile strength that is not sufficient to withstand normal wear and tear without breaking. Furthermore, since hollow rings have relatively thin walls, very high tolerances are required to remove material from the ring walls using a diamond cutting machine, which tolerances have heretofore not been reliably achievable due in large measure to the difficulties experienced in uniformly winding a rope chain on the drum of a lathe such that the surfaces of the chain are precisely and uniformly positioned. Only when the chain surfaces are so positioned is it possible to remove a portion of the material from the walls of the individual rings.

Accordingly, there exists a need for a process for manufacturing rope chain jewelry from hollow rings of gold material.

BRIEF SUMMARY OF THE INVENTION

A process for manufacturing diamond cut rope chain jewelry from hollow rings of gold material or other precious metal or alloy. The process provides for the formation of hollow rope jewelry having faceted surfaces formed by a diamond cut process.

In accordance with the present invention, rings of a suitable precious metal, such as gold alloy, are manufactured according to known methods wherein gold alloy wire is flattened and formed about an iron or aluminum wire core in such a way that gold alloy wire may be converted into open rings with the use of suitable ring making machines. The "rings" can be round, square, rectangular, or oval, or any other suitable shape. The rings are then woven and soldered in such a way that their consecutive layout will be harmonious and, most importantly, that a generally uniform and flexible chain is formed. After the chain has been formed, it is then passed through a die having a measurement that is equal to the outside diameter of the chain, wherein the cross-section of the chain is made uniform within manufacturing tolerances and wherein defective parts, i.e. parts not suitably weaved or soldered, are detected and the defects remedied or eliminated.

The extraction of the iron or aluminum core is achieved by immersing the chain in hydrochloric acid or caustic soda whereby the core material is dissolved leaving a chain consisting of a plurality of hollow core gold alloy rings. Next, the chain assembly is tempered in a thermal process that yields an increased tensile strength. According to a preferred embodiment, the present invention the utilizes a gold alloy consisting in part of cobalt, which provides an alloy suitable for undergoing thermal tempering, resulting in a hollow rope chain having a greater tensile strength and, hence, increased break resistance. The tempering process preferably includes exposing the chain to a temperature of 300° C. for one hour, and subsequently cooling the chain to room temperature.

Once tempered, the chain is ready for diamond cutting. An ice diamond cut lathe is used for the diamond cut. The chain is first wound about the rotary drum of the ice lathe following a constant spiral sequence. To insure that the rope chain is placed correctly over the rotary drum and that no parts of the chain are protruding, a tool has been manufactured which consists of a convex mass of polished steel which is applied against the chain for the purpose of eliminating the above-referenced protrusions. The polished steel tool is mounted or installed on the cross-carriage of the ice diamond cut lathe in such a way that it can slide along the rotary drum, pressing the chain gently to achieve an even and uniform cross-section. Once a uniform cross-section has been achieved, a cold water shower is sprayed over the chain and rotary drum while the drum assembly is exposed to freezing temperatures for the purpose of creating a suitable layer of ice over the chain for fixing the chain on the surface of the drum. Once a suitable layer of ice is formed, a diamond tipped cutting blade is mounted on the cross-carriage of the lathe and is used to cut through the ice and remove a portion of the surface from selected rings of the chain thereby producing a faceted surface and shiny faces characteristically of the diamond cut chain.

Finally, the chain is inspected to detect defects inherent to the general process, and is exposed to the chemical polishing of sodium cyanide and hydrogen peroxide. The final appearance of the hollow, diamond cut chain according to the instant process is identical to regular, solid, diamond cut chain, and is produced more cost effectively.

In accordance with these and other objects which will become apparent hereinafter, the instant invention will now be described with particular reference to the accompanying drawings.

DETAILED DESCRIPTION OF THE INVENTION

In accordance with the present invention, a process for manufacturing diamond cut rope chain jewelry from hollow rings of gold material or other precious metal or alloy is provided. The process provides for the formation of hollow rope jewelry having faceted surfaces formed by a diamond cut process and provides hollow rope chain jewelry weighing up to 60% less than similar solid rope chain jewelry.

Figure 1:
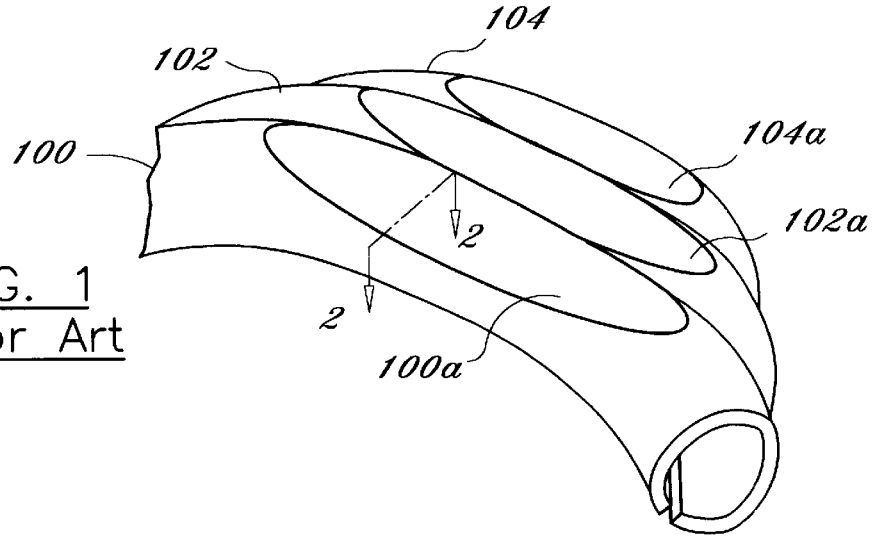
FIG. 1 Prior Art
FIG. 1 illustrates a side view of a portion of a hollow rope chain having simulated diamond cut surfaces formed by deforming surfaces according to methods of the background art.
Figure 2:
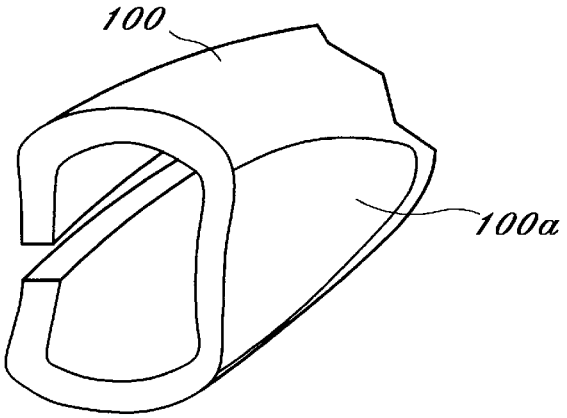
FIG. 2 Prior Art
FIG. 2 illustrates a sectional perspective view along line 2—2 of FIG. 1.

FIGS. 1 and 2 illustrate hollow rope chain jewelry formed according to methods of the background art by a process that includes incremental deforming hollow links. FIG. 1 depicts three hollow ring links 100, 102 and 104. Each hollow ring link includes a faceted surface portion, referenced as 100*a*, 102*a* and 104*a* respectively, formed by the deformation of the hollow ring wall. FIG. 2 depicts a sectional perspective view of hollow ring 100 and clearly depicts the deformation of the ring wall resulting in faceted surface 100*a*. The ring walls have a thickness ranging between 0.002" and 0.008". The relatively thin wall thickness has heretofore prevented forming faceted surfaces thereon by diamond cutting, thus limiting methods of the background art to simulating faceted surfaces by deformation.

According to the process of the present invention, rings of a suitable precious metal, such as gold alloy, are manufactured according to methods of the background art wherein a metal alloy, such as gold alloy, in the form of wire is flattened by cold working thereby deforming the alloy below the recrystallization temperature, and forming the flattened alloy about a core of iron or aluminum wire in such a way that the alloy is converted into open rings by a suitable ring making machine. The "rings" can be annular or round, square, rectangular, or oval, or any other suitable shape. The rings will be linked with other rings for form a chain. Each link of the chain is woven and soldered in such a way that the consecutive layout will be harmonious and, most importantly, that a generally uniform and flexible chain is formed.

After the chain has been formed, it is then passed through a die having a measurement that is equal to the outside diameter of the chain, wherein the cross-section of the chain is made uniform within manufacturing tolerances and wherein defective parts, i.e. parts not suitably weaved or soldered, are detected and the defects remedied or eliminated.

The extraction of the iron or aluminum core material is achieved by immersing the chain in hydrochloric acid or caustic soda whereby the core material is dissolved leaving a chain consisting of a plurality of hollow core gold alloy rings. Next, the chain assembly is tempered in a thermal process that yields an increased tensile strength. According to a preferred embodiment, the present invention utilizes a gold alloy consisting in part of cobalt, which provides an alloy suitable for undergoing thermal tempering, resulting in a hollow rope chain having a greater tensile strength and, hence, increased break resistance. The tempering process preferably includes exposing the chain to a temperature of 300° C. for one hour, and subsequently cooling the chain to room temperature.

Figure 3:
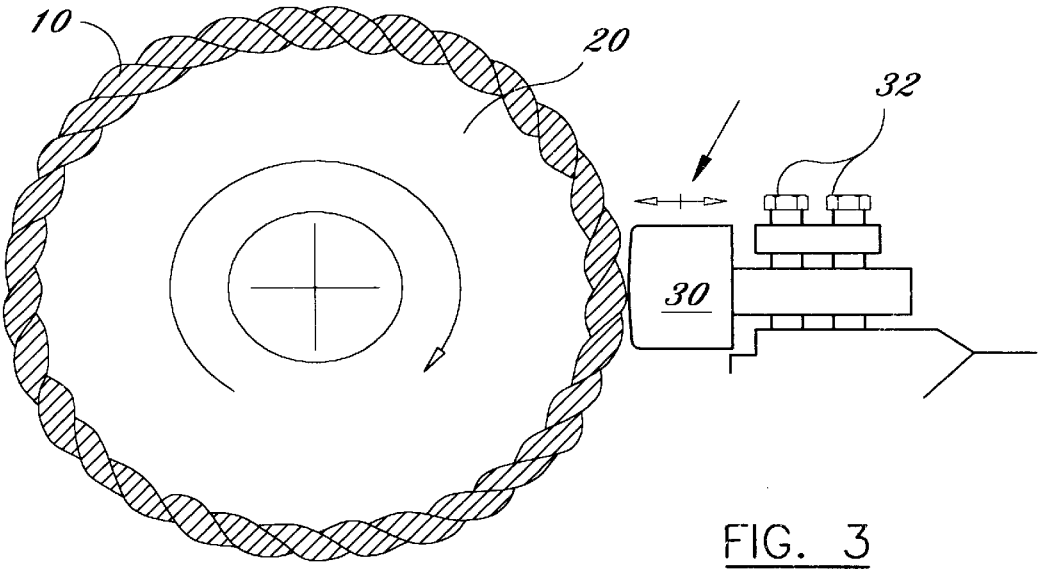
FIG. 3 is a side view of a hollow rope chain disposed on a rotating drum.
Figure 4:
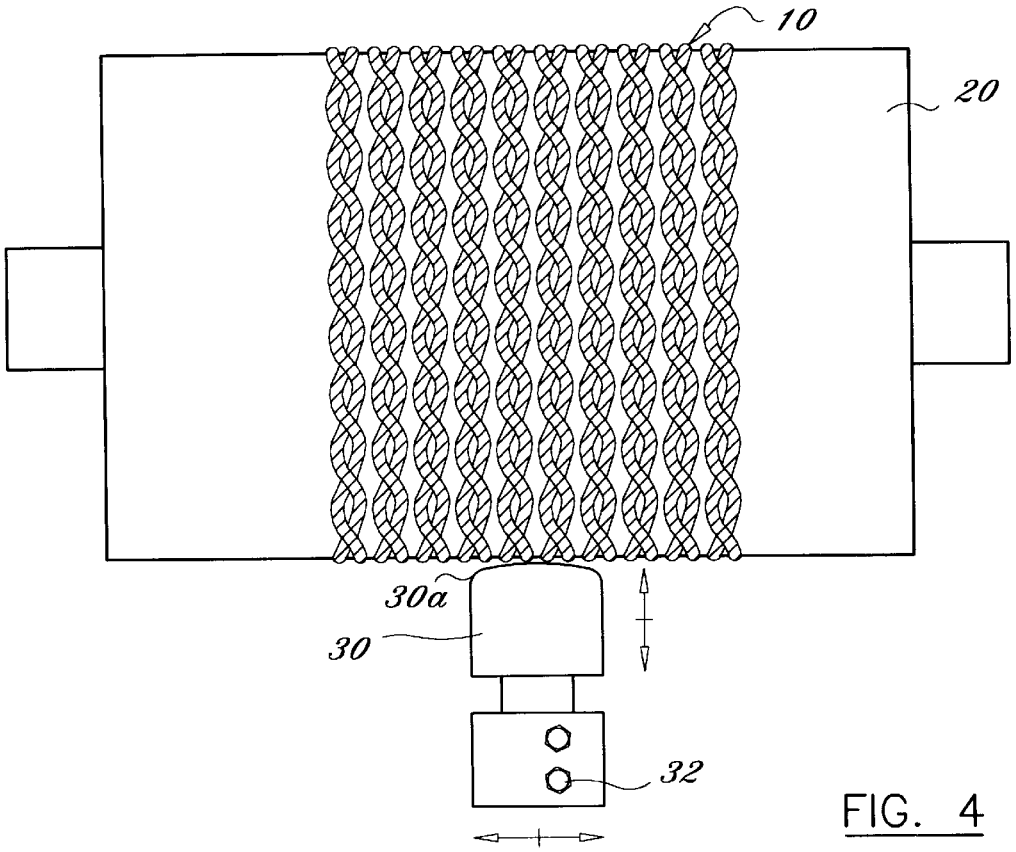
FIG. 4 is a top view of a hollow rope chain disposed on a rotating drum.
Figure 5:
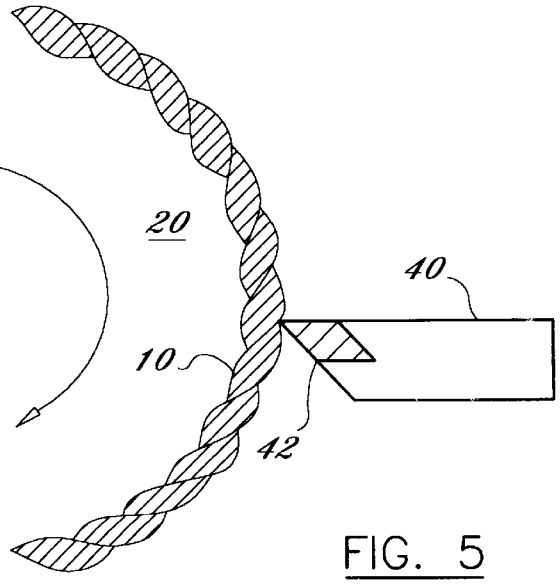
FIG. 5 is a side view of a hollow rope chain disposed on a rotating drum while a diamond cutting tool removes material from the chain.
Figure 6:
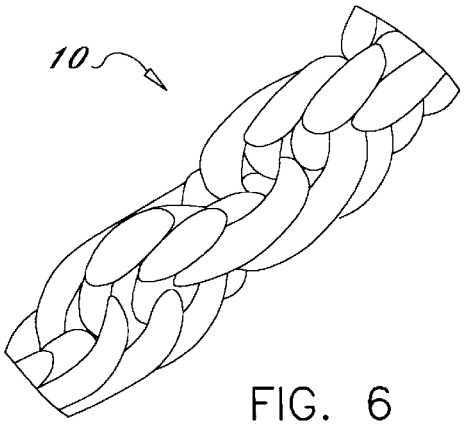
FIG. 6 is a detail view of a hollow rope chain having a diamond cut faceted surface.

Once tempered, the chain 10 is ready for placement on a rotatable cylindrical drum 20 of a diamond cutting lathe as best shown in FIGS. 3 and 4. The chain is first wound about the rotary drum of the ice lathe following a constant spiral sequence as best seen in FIG. 4. Once chain 10 is wound about drum 20 a tool, generally referenced as 30, comprising a convex mass of polished steel is mounted on a tool retaining carriage 32 of the lathe and precisely positioned a predetermined distance from drum 20. The polished steel tool is mounted or installed on the cross-carriage of the ice diamond cut lathe in such a way that it can slide along the rotary drum, pressing the chain gently to achieve an even and uniform cross-section. Accordingly, when drum 20 is caused to rotate the convex surface 30*a* of tool 30 contacts any protruding or irregular portions of the chain and urges said protruding or irregular portion into conformance with the remaining portions of the chain thereby achieving a uniform configuration and insuring that the rope chain is properly positioned on drum 20 and that no parts of the chain are protruding. The use of tool 30 to properly position the chain is an important aspect of the invention, since the positioning of the chain is critical to a latter diamond cutting step more fully discussed herein below.

Once a uniform cross-section has been achieved, a cold water shower (not shown) is sprayed over the chain and rotary drum while the drum assembly is exposed to freezing temperatures. Accordingly, water works its way around the chain and into the voids formed by linked rings and is caused to freeze for the purpose of creating a suitable layer of ice over the chain for fixing the chain on the surface of the drum. Once a suitable layer of ice is formed, a diamond tipped cutting blade, generally referenced as 40, having a diamond cutting tip 42 is mounted on the lathe cross-carriage 32 and is used to cut through the ice and remove a portion of the surface from selected rings of the chain thereby producing a faceted surface. Specifically, during the cutting process, the diamond cutting tool 40 produces a cut on the surface, thereby removing a quantity of material producing the shiny faces characteristically of the diamond cut chain.

Finally, the chain is inspected to detect defects inherent to the general process, and is exposed to the chemical polishing of sodium cyanide and hydrogen peroxide. The final appearance of the hollow, diamond cut chain according to the instant process is identical to regular, solid, diamond cut chain, and is produced more cost effectively.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A process for making diamond cut hollow rope chain jewelry including the steps of:

(a) mounting a chain formed from a plurality of interlinked hollow rings on a generally cylindrical rotatable drum component of a lathe by winding the chain in a uniform spiral about said drum;

(b) mounting a first tool on a tool retaining carriage of said lathe, said first tool including a head having a convex polished steel surface;

(c) precisely positioning said tool head a predetermined distance from said drum, said predetermined distance being substantially equal to said chain desired outer diameter;

(d) rotating said drum such that said convex polished steel surface contacts portions of said chain which extend beyond said chain desired outer diameter and urges said portions into conformance with said chain desired outer diameter;

(e) moving said tool retaining carriage such that said tool head moves along the axis of rotation of said drum;

(f) spraying water on said drum and causing said water to freeze thereon whereby said chain is fixed to said drum by ice formed thereon;

(g) mounting a second tool on said tool retaining carriage of said lathe, said second tool including a diamond tipped cutting head;

(h) precisely positioning said second tool head a predetermined distance from said drum, said predetermined distance being slightly less than said chain desired outer diameter;

(i) rotating said drum such that said diamond tipped cutting head contacts portions of said chain and removes alloy material from said chain (j) moving said tool retaining carriage such that said diamond tipped cutting head moves along the axis of rotation of said drum thereby removing alloy material from a plurality of locations on said chain.

2. A process for making diamond cut hollow rope chain jewelry according to claim 1, wherein said hollow rings each have a wall thickness of between 0.002" and 0.008".

3. A process for making diamond cut hollow rope chain jewelry according to claim 1, further including the step of:

exposing said chain to a temperature controlled environment wherein the chain is tempered in a thermal process that yields an increased tensile strength.

4. A process for making diamond cut hollow rope chain jewelry including the steps of:

(a) cold working gold alloy material thereby plastically deforming the alloy material into a generally flattened shape;

(b) forming the flattened alloy material, about core material consisting of either iron or aluminum, into a plurality of alloy rings;

(c) joining said plurality of alloy rings into a chain;

(d) placing said chain in a die having inner dimensions, including an inner diameter, which are equal to the desired outer dimensions, including an outer diameter, of said chain, for plastically deforming any portions of said chain which exceed said desired outer dimensions such that said chain is deformed so as to conform with said desired outer dimensions;

(e) exposing said chain to an acid solution causing the core material to dissolve such that said rings become hollow;

(f) exposing said chain to a temperature controlled environment wherein the chain is tempered in a thermal process that yields an increased tensile strength;

(g) mounting said chain on a generally cylindrical rotatable drum component of a lathe by winding the chain in a uniform spiral about said drum;

(h) mounting a first tool on a tool retaining carriage of said lathe, said first tool including a head having a convex polished steel surface;

(i) precisely positioning said tool head a predetermined distance from said drum, said predetermined distance being substantially equal to said chain desired outer diameter;

(j) rotating said drum such that said convex polished steel surface contacts portions of said chain which extend beyond said chain desired outer diameter and urges said portions into conformance with said chain desired outer diameter;

(k) moving said tool retaining carriage such that said tool head moves along the axis of rotation of said drum;

(l) spraying water on said drum and causing said water to freeze thereon whereby said chain is fixed to said drum by ice formed thereon;

(m) mounting a second tool on said tool retaining carriage of said lathe, said second tool including a diamond tipped cutting head;

(n) precisely positioning said second tool head a predetermined distance from said drum, said predetermined distance being slightly less than said chain desired outer diameter;

(o) rotating said drum such that said diamond tipped cutting head contacts portions of said chain and removes alloy material from said chain (p) moving said tool retaining carriage such that said diamond tipped cutting head moves along the axis of rotation of said drum thereby removing alloy material from a plurality of locations on said chain.

* * * * *